US006360636B1

(12) United States Patent
Elftmann

(10) Patent No.: US 6,360,636 B1
(45) Date of Patent: Mar. 26, 2002

(54) TOOL FOR REMOVING A DRAIN BASKET OR SIMILAR FITTING

(76) Inventor: Arthur Joseph Elftmann, 4809 W. Sandra Ter., Glendale, AZ (US) 85306

( * ) Notice: Subject to any disclaimer, the term of this patent is extended or adjusted under 35 U.S.C. 154(b) by 0 days.

(21) Appl. No.: 09/545,778

(22) Filed: Apr. 7, 2000

Related U.S. Application Data

(60) Provisional application No. 60/128,547, filed on Apr. 9, 1999.

(51) Int. Cl.[7] ..... B25B 23/08
(52) U.S. Cl. ..... 81/445; 81/442
(58) Field of Search ..... 81/442, 443, 444, 81/445, 446

(56) References Cited

U.S. PATENT DOCUMENTS 2,497,633 A * 2/1950 Shapiro et al. ..... 81/445
2,914,330 A * 11/1959 Wheeler ..... 81/445
3,181,396 A * 5/1965 Nance ..... 81/445
3,902,384 A * 9/1975 Ehrler ..... 81/445
4,724,608 A * 2/1988 Parrott ..... 29/724
5,094,496 A * 3/1992 King, Sr. ..... 294/96
5,669,404 A * 9/1997 Guillermo ..... 81/444

* cited by examiner

*Primary Examiner*—Joseph J. Hail, III
*Assistant Examiner*—Joni B. Danganan
(74) *Attorney, Agent, or Firm*—Gregory J. Nelson

(57) ABSTRACT

A tool for removing a drain basket of the type in threaded engagement at the drain pipe of a sink, tub or the like. The tool has a body with a lug at the upper end, an intermediate section having external left-hand threads and a lower skirt section which is conical. Curved shoes are retained about the lower section by an elastomeric band. A nut is engaged with the threaded section and a washer is interposed between the nut and upper ends of the shoes. The tool is inserted into a drain and the body held by a wrench engaging the lug. The nut is turned with a second wrench in a counter-clockwise direction causing the skirt to move upwardly relative to the shoes forcing the shoes outwardly and downwardly into tight engagement with the drain basket. The tool can then be further rotated in a counter-clockwise direction causing the basket to loosen

7 Claims, 2 Drawing Sheets

TOOL FOR REMOVING A DRAIN BASKET OR SIMILAR FITTING

REFERENCE TO RELATED APPLICATION

This application is based on provisional application Serial No. 60/128,547, titled "Tool For Removing Drain Basket" filed Apr. 9, 1999.

FIELD OF THE INVENTION

The present invention relates to a plumbing tool useful for removing a drain basket or strainer from the outlet of a tub, basin or sink.

BACKGROUND OF THE INVENTION

A drain basket also sometimes termed a "strainer" is a fitting which is secured at the discharge opening in the bottom of a fixture such as a basin, sink or bathtub. The drain basket is typically cup-shaped and is positioned in the drain or outlet of the plumbing fixture and has an external threaded body portion which is in threaded engagement with the drain line. Cross members extend across the bottom of the basket. Removing the basket when plumbing repairs are necessary can be difficult particularly if the basket or strainer has been installed for some period of time and has become rusted. There are various specialized tools in the prior art for removing and installing drain fixtures such as those found in sinks and tubs.

U.S. Pat. No. D 382,788 shows an ornamental design for an alignment tool for installing bathtub drains which has a number of adjustable arms which can be extended to engage the bottom and side walls of the tub.

U.S. Pat. No. 4,835,798 shows a centering tool for disposing and maintaining a basket sink strainer in concentric and parallel relationships with respect to the sink drain hole. The tool of the '798 patent comprises a tubular spider having upper and lower horizontal arms with telescopically extensible tubular elements that are positional to contact the corners of the sink. An adapter depending from the center carries a pronged element that engages the slots in the bottom well of the sink strainer.

There are other specialized drain removing tools such as those shown in U.S. Pat. No. D 391816 and U.S. Pat. No. 5,199,331. These latter two patents are intended for use for removing drain plugs from vehicle engine oil pans.

U.S. Pat. No. 5,103,698 shows a tool for use that is attachable to the drain basket of a sink. The tool has a cylindrical body with lugs projecting longitudinally from one end. The lugs of the tool are shaped in dimension to fit into the drain apertures near the bottom of the cup. There is a radially extending ring around the base. The tool is attached to the external bottom of the drain basket by inserting the lugs through the cup-like portion into the slots and then applying a lower flange around the tool body and threading it onto the lower threaded fitting which extends down from the cup.

Nevertheless, there exists a need for a tool to assist plumbers in removing drain baskets, which tool is simple to use and effective for the intended purpose.

SUMMARY OF THE INVENTION

The present invention relates to a plumbing tool for removing drain baskets which tool has a body with a wrench receiving lug at the top end, an intermediate reversely threaded body and a lower skirt which tapers outwardly.

Expandable shoes are arranged about the body and a nut engaged with the threaded body portions. A washer is interposed between the nut and the upper end of the shoes. The nut is secured by a wrench and then turned to advance the body upwardly once the tool is inserted in a drain. As the body moves, the tapered skirt on the body will force the shoes radially outwardly into tight engagement with the interior of the basket. Continued rotation of the nut, once engagement occurs, will cause the basket to be loosened as the threads are left hand threads which will cause the basket to be turned in a normal counter-clockwise loosening direction. If the body of the tool tends to rotate along with the nut, it can be held by engaging a wrench to the lug at the top of the body.

BRIEF DESCRIPTION OF THE DRAWINGS

The present invention will be better understood from the following description and drawings in which.

DETAILED DESCRIPTION OF THE DRAWINGS

Figure 1:
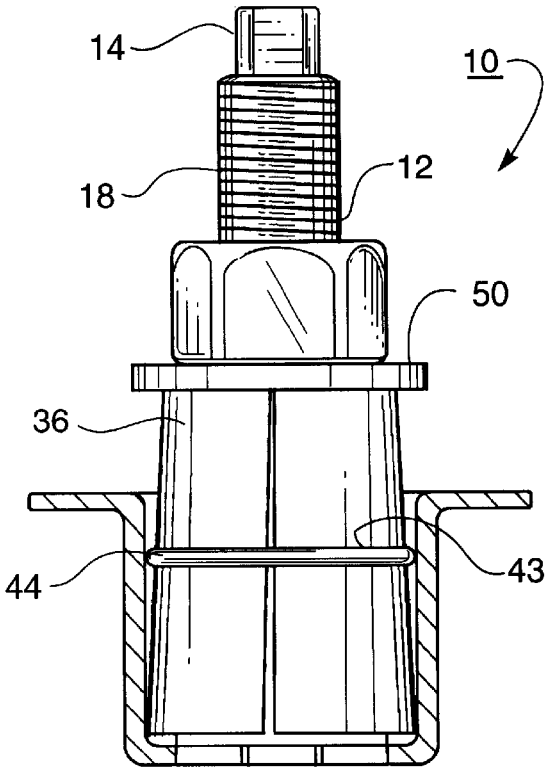
FIG. 1 is an elevational view of the drain remover tool of the present invention installed in a drain basket, the basket being shown in a cross-section.

Turning now to the drawings, the tool of the present invention is generally designated by the numeral 10. The tool 10 has an axially extending body member 12. Body member 12 has a lug 14 at its upper end and an intermediate section 16 which is provided with external threads 18 and lower skirt 20. External threads 18 are preferably reverse or left-handed threads as will be explained hereafter and extend to the top of the skirt 20. The skirt 20 has a generally smooth outwardly flared conical surface 22 which serves as a cam surface. The lower end of the conical section terminates at flat end surface 25.

Figure 4:
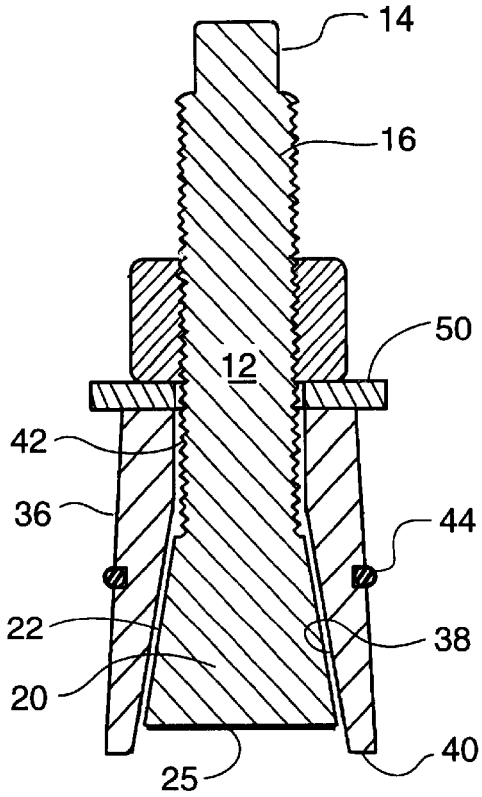
FIG. 4 is a cross sectional view of the drain removing tool taken along line 4—4 of FIG. 2.
Figure 2:
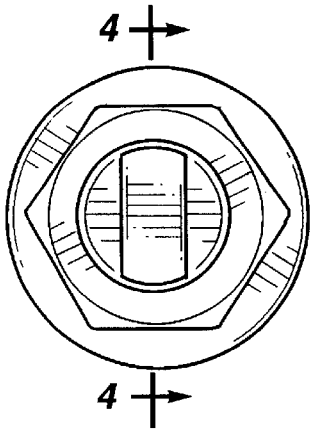
FIG. 2 is a top view of the tool.
Figure 3:
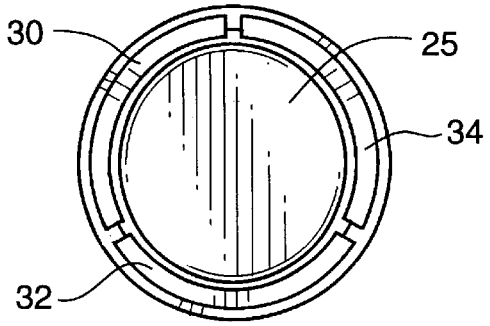
FIG. 3 is a bottom view of the tool.

A plurality of shoes 30, 32 and 34 each having an arcuate outer surface 36 are positioned about the body 12. The inner surface of each of the shoes has an upper arcuate surface 42 and a lower surface which is arcuate and also flares outwardly along surface 38 to the lower end 40. In the normal position prior to use, the shoes 30, 32 and 34 will be positioned as shown in FIG. 4 with their outer surfaces cooperating to establish a generally cylindrical continuous outer surface. The shoes in their normal, unactuated position have an inner surface configuration at 42 which conforms to the lower portion of body 12 and conical section 38 which conforms to the surface 22 of the skirt section 20.

At an intermediate location, each of the shoes defines an exterior groove or slot 43 which receives an elastomeric retaining member 44 such as an O-ring. A washer 50, annular in shape, defines a central opening 52 which is received over the body 12 abutting the upper surface of the arcuate shoes 30, 32 and 34. A nut 60, has threads 62 in engagement with threads 18 of the body section 16, and abuts the upper surface of the washer 50.

The threads 18 as well as the threads 62 on the nut 60 are left-hand or reverse threads so that by restraining the body and rotating nut 60 in a counter-clockwise direction, the body will advance upwardly relative to the nut and the shoes applying an expanding force to the shoes 30, 32 and 34 as the cam surface 22 at the lower end of the axially extending body member 12 moves along surface 38 of the shoes. Once the shoes expand to tightly engage the interior of the drain basket, further rotation in a counter-clockwise direction will be imparted to the drain basket in a normally loosening direction causing the drain basket to unseat. The relatively large nut 60 provides a substantial gripping surface for application of a wrench.

Figure 5:
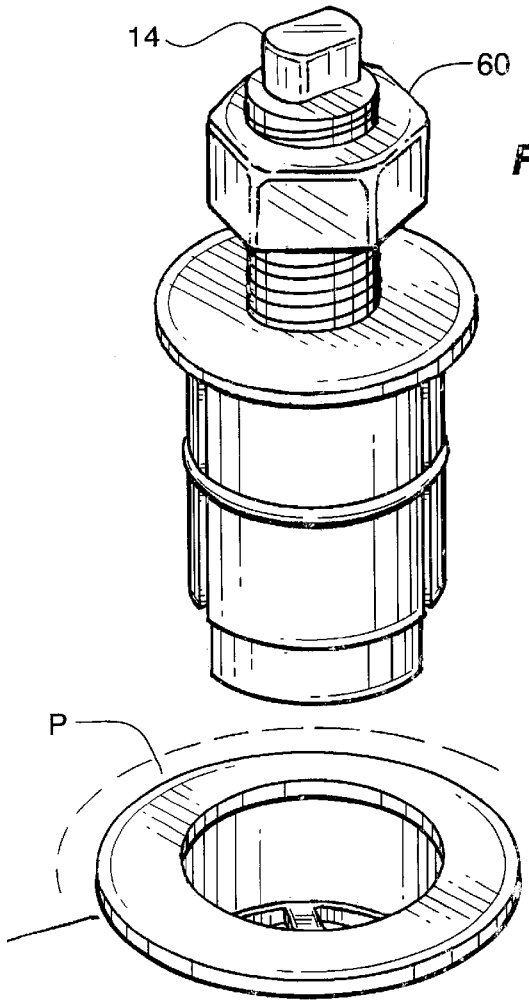
FIG. 5 is a perspective view showing the tool as it is aligned with a drain opening.
Figure 6:
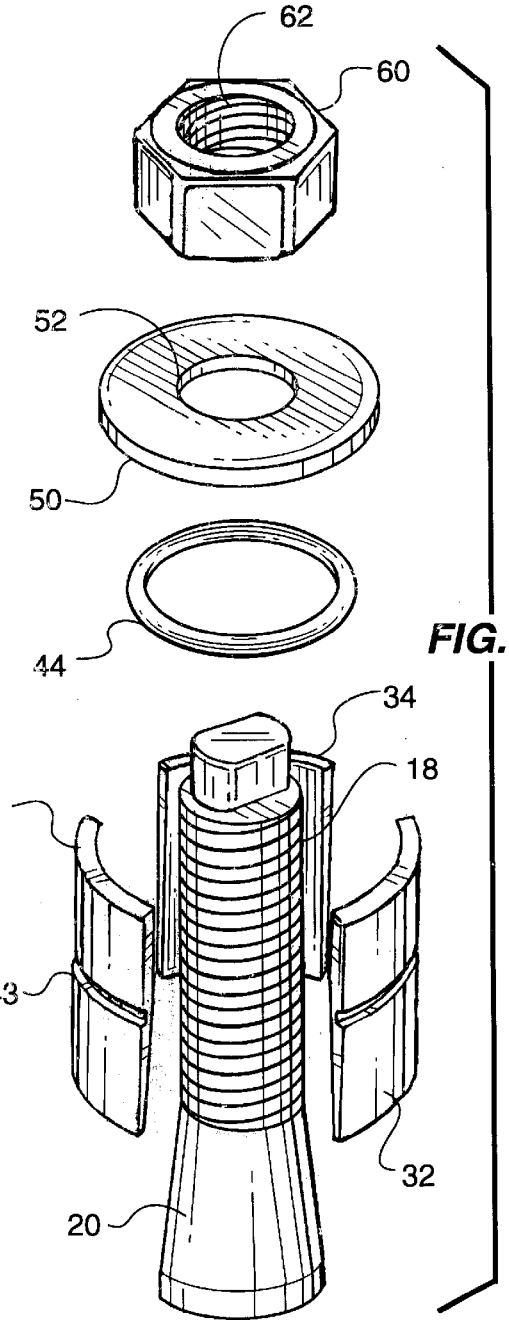
FIG. 6 is an exploded view of the tool of the invention.
Figure 7:
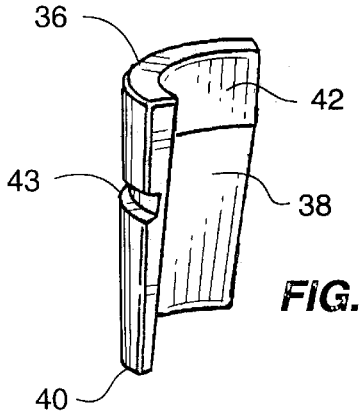
FIG. 7 is a detail drawing of one of the shoes.

The present invention will be better understood for the following description of use. As seen in FIG. 5, the tool 10 is manually positioned in an axial alignment with the center of the drain basket "D." The tool is then fully inserted into the drain to the position seen in FIG. 1. The nut 60 has been advanced to a position along the threaded section 18 so the outer surfaces of the shoes establish a generally cylindrical configuration and the bottom end 25 of the body is at or slightly above ends 40 of the shoes. Once the tool is seated in the basket or drain, the user may then apply a wrench to the nut to the faces of nut 60 and counter-clockwise rotation imparted to the nut. As rotation occurs, the body 12 will be caused to move axially upwardly along the threads 18. The skirt surface 22 will apply a spreading force to the lower end of shoes 30, 32 and 34. As the shoes are moved outwardly, they will engage the internal side walls of the drain as seen in FIG. 4. As the nut 60 is continued to be tightened, the shoes will expand into firm frictional engagement with the side walls of the drain basket. Further rotation of the nut will then cause the entire drain to rotate in a counter-clockwise direction unscrewing the drain from the plumbing fixture to which it is attached. The substantial size of the exterior surfaces of shoes provide a tight frictional engagement with the interior of the fitting. If the body 12 begins to turn with rotation of nut 60, a wrench may be applied to the lug surface 14.

The tool may be made from suitable materials such as mild steel. The shoes may be machined from steel or aluminum, or other suitable materials. In a preferred embodiment of the invention, the threads 18 are 7/8 inch diameter reverse threads. The washer 50 has an outside diameter of 1 5/8 inches and the diameter of the castles at the bottom of the cam surface are approximately 1 1/8 inch. The bore 52 at the bottom of the cam surface is 5/8 inch diameter by 3/4 inch deep.

A tool having the dimensions described above is suitable for most applications and will in a closed or retracted position have a diameter of about 1½inches and will expand to a diameter of about 1⅞inches. The tool has applications other than for convention tub drains, and tools of this design may be provided in various sizes and will be effective for removing drains and plugs of other sizes and configurations.

It will be apparent from the above descriptions, that it will be obvious to those skilled in the art to make various changes, modifications and alterations to the invention described herein. To the extent that these various changes, modifications and alterations do not depart from the spirit and scope of the invention, they are intended to be encompassed therein.

I claim:

1. A tool for removing a drain basket which basket is in threaded engagement with a drain pipe of a plumbing fixture, said tool comprising:

(a) an axially extending body having a surface for engagement with a tool at
the upper end, an intermediate section having external left hand threads
and a lower section defining a cam surface;

(b) at least two shoes extending about said body and held by an elastomeric
retainer, said shoes in a first position defining a generally cylindrical outer
surface;

(c) a nut on said threaded section abutting said shoes, said nut being
advanceable along said body to move said cam surface relative to said
shoes expanding them into frictional engagement with the interior of said
basket.

2. The tool of claim 1 wherein said tool is fabricated from steel.

3. The tool of claim 1 further including a washer interposed between said nut and said shoes.

4. The tool of claim 1 wherein said surface for engagement with a tool comprises flat faces defining a lug.

5. The tool of claim 1 wherein said at least two shoes comprises three shoes each defining an annular groove receiving said elastomeric member.

6. The tool of claim 1 wherein said shoes each have an inner surface with upper section which when assembled form a cylindrical socket and a lower section which when assembled form a generally conical socket.

7. A tool for removing a drain basket which is in threaded engagement with a plumbing fitting, said tool comprising:

(a) an axially extending body having a surface for engagement with a tool at
the upper end, an intermediate section having external threads and a lower
body section defining a cam surface;

(b) at least two shoes extending about the body;

(c) retaining means securing said shoes about said body in a first position in
which the shoes define a generally cylindrical outer surface and permitting
movement of the shoes to a second expanded position; and (d) a threaded member in engagement with said external threads advanceable
along said body to move said cam surface relative to said shoes to move
said shoes to said second position into frictional engagement with the
interior of said fitting.

* * * * *